US008378201B2

(12) United States Patent
Sato

(10) Patent No.: US 8,378,201 B2
(45) Date of Patent: Feb. 19, 2013

(54) RESONANCE GENERATION DEVICE OF ELECTRONIC MUSICAL INSTRUMENT, RESONANCE GENERATION METHOD OF ELECTRONIC MUSICAL INSTRUMENT, COMPUTER PROGRAM, AND COMPUTER READABLE RECORDING MEDIUM

(75) Inventor: Hiroshi Sato, Shizuoka (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 46 days.

(21) Appl. No.: 10/578,871

(22) PCT Filed: Dec. 14, 2004

(86) PCT No.: PCT/JP2004/018625

§ 371 (c)(1),
(2), (4) Date: May 11, 2006

(87) PCT Pub. No.: WO2005/066928

PCT Pub. Date: Jul. 21, 2005

(65) Prior Publication Data

US 2007/0084334 A1 Apr. 19, 2007

(30) Foreign Application Priority Data

Jan. 9, 2004 (JP) ..... 2004-004013

(51) Int. Cl.
*G10H 1/06* (2006.01)

(52) U.S. Cl. ..... 84/662; 84/609; 84/622; 84/659

(58) Field of Classification Search ..... 84/600–616, 84/622–635, 637–638, 645, 647–651, 653–667, 84/669, 735–746, 19–29, 33–38, 170–172, 84/174, 189–199, 216–218, 225–234
See application file for complete search history.

(56) References Cited

U.S. PATENT DOCUMENTS 5,252,774 A * 10/1993 Hasebe et al. ..... 84/618
5,432,856 A 7/1995 Shioda ..... 381/63

(Continued)

FOREIGN PATENT DOCUMENTS

JP 04-121789 4/1992
JP 04-166896 6/1992

(Continued)

OTHER PUBLICATIONS

Office Action dated May 25, 2010 corresponding to Japanese Patent Application No. 2004-004013 with English language Summary page.

(Continued)

*Primary Examiner* — Christopher Uhlir
(74) *Attorney, Agent, or Firm* — Kratz, Quintos & Hanson, LLP

(57) ABSTRACT

A resonance generation device of an electronic musical instrument, including: a key depression state detecting means detecting whether a key which is in a specific relation with a played key is already depressed or not when a key playing operation is performed; a specific relation detecting means detecting the relation between the played key and the depressed key when the key depression state detecting means detects that the key in the specific relation with the played key is already depressed; and a musical sound generation means sound generating a musical sound of the played key when the specific relation detecting means detects that the played key and the depressed key are in the specific relation set in advance, and generating a predetermined musical sound based on the relation between the played key and the depressed key so that a position of the depressed key is to be a sound generation source.

13 Claims, 5 Drawing Sheets

U.S. PATENT DOCUMENTS

| | | | | |
|---|---|---|---|---|
| 5,498,834 | A * | 3/1996 | Inagaki et al. | 84/622 |
| 5,747,714 | A * | 5/1998 | Kniest et al. | 84/604 |
| 5,804,751 | A * | 9/1998 | Koseki et al. | 84/604 |
| 5,854,438 | A * | 12/1998 | Assayag et al. | 84/625 |
| 6,118,065 | A * | 9/2000 | Haruyama | 84/609 |
| 6,316,711 | B2 * | 11/2001 | Matsuda et al. | 84/615 |
| 2002/0166441 | A1 * | 11/2002 | Washiyama et al. | 84/662 |

FOREIGN PATENT DOCUMENTS

| | | |
|---|---|---|
| JP | 6-118956 | 4/1994 |
| JP | 06-130942 | 5/1994 |
| JP | 9-330079 | 12/1997 |
| JP | 10-293578 | 11/1998 |
| JP | 10-319949 | 12/1998 |
| JP | 2001-350487 | 12/2001 |
| JP | 2003-208182 | 7/2003 |

OTHER PUBLICATIONS

Japanese Office Action issued in corresponding application No. 2010-165748 dated Jul. 10, 2012 with English summary (3 pages).

* cited by examiner

FIG. 5

| DIFFERENCE BETWEEN DEPRESSED KEY AND PLAYED KEY (PLAYED KEY−DEPRESSED KEY) | PITCH OF RESONANCE | CONCRETE EXAMPLES, WHEN DEPRESSED KEY IS C3 (48) |
|---|---|---|
| +12 * N+2 (N:3~) | PLAYED KEY | PLAYED KEY 86, PITCH OF RESONANCE IS 86 |
| +12 * N+10 (N:2~) | PLAYED KEY | PLAYED KEY 82, PITCH OF RESONANCE IS 82 |
| +12 * N+4 (N:2~) | PLAYED KEY | PLAYED KEY 76 OR 88, PITCH OF RESONANCE IS 76 OR 88 |
| +12 * N+7 (N:1~) | PLAYED KEY | PLAYED KEY 67, 79, OR 91, PITCH OF RESONANCE IS 67, 79 OR 91 |
| +12 * N (N:1~) | PLAYED KEY | PLAYED KEY 60, 72, 84, OR 96, PITCH OF RESONANCE IS 60, 72, 84, OR 96 |
| +7 | DEPRESSED KEY+19KEYS | PLAYED KEY 55, PITCH OF RESONANCE IS 67 |
| +5 | DEPRESSED KEY+24KEYS | PLAYED KEY 53, PITCH OF RESONANCE IS 72 |
| ±1 | DEPRESSED KEY | PLAYED KEY 47 OR 49, PITCH OF RESONANCE IS 48 |
| −5 | DEPRESSED KEY+19KEYS | PLAYED KEY 43, PITCH OF RESONANCE IS 67 |
| −7 | DEPRESSED KEY+12KEYS | PLAYED KEY 41, PITCH OF RESONANCE IS 60 |
| −12 * N (N:1~) | DEPRESSED KEY | PLAYED KEY 36 OR 24, PITCH OF RESONANCE IS 48 |
| −12 * N−7 (N:1~) | DEPRESSED KEY | PLAYED KEY 29, PITCH OF RESONANCE IS 48 |

RESONANCE GENERATION DEVICE OF ELECTRONIC MUSICAL INSTRUMENT, RESONANCE GENERATION METHOD OF ELECTRONIC MUSICAL INSTRUMENT, COMPUTER PROGRAM, AND COMPUTER READABLE RECORDING MEDIUM

TECHNICAL FIELD

The present invention relates to a resonance generation device of an electronic musical instrument, a resonance generation method of the electronic musical instrument, a computer program, and a recording medium, in particular, to the electronic musical instrument suitable for use to generate a musical sound closer to a natural musical instrument in an electronic musical instrument modeling on an acoustic piano.

BACKGROUND ART

When a sound closer to a natural musical instrument is to be generated in an electronic musical instrument, it is necessary to collect and faithfully reproduce an original sound. For example, in an acoustic piano and so on such as a grand piano, it is known that a keyboard is played and a hammer hits a string, and then, a string in harmonic relation with the hit string and a soundboard resonate to thereby generate a resonance. An actual acoustic piano generates a rich musical sound by generating various resonances as stated above in addition to the original sound.

Consequently, for example, a technique stated below is proposed in Patent Document 1, to obtain such resonance effect in the electronic musical instrument.

Namely, in the above-stated Patent Document 1, a technique in which a resonance generated by a keystroke sound is additionally sound generated when a key in a specific relation with a depressed key is stroked, to thereby generate a performance sound close to the performance sound of the acoustic piano, is proposed.

In the electronic musical instrument described in the above-stated Patent Document 1, an idea in which a resonance is sound generated in addition to a keystroke sound is disclosed, but a way how to sound generate the above-stated resonance to be added is not thought out. Consequently, there was a problem that it is difficult to obtain a sharp contour and clear sound quality because there is no scheme when the above-stated original sound and the resonance are outputted, and therefore, the sounds are mixed together, even though the resonance is added to generate the performance sound close to the acoustic piano.

Consequently, in case of the electronic musical instrument described in the above-stated Patent Document 1, there was a limit to reproduce a spread and rich musical sound in which the resonance peculiar to the natural musical instrument such as the acoustic piano is added.

Patent Document 1: Japanese Patent Application Laid-open No. Hei 6-118956

SUMMARY OF THE INVENTION

An object of the present invention is to provide an electronic musical instrument capable of obtaining a spread feeling and a sound quality feeling close to a natural musical instrument in a resonance generation device of an electronic musical instrument creating a resonance from an original sound in consideration with the above-stated problems.

According to the present invention, a resonance generation device of an electronic musical instrument, having a digital signal processing unit artificially creating a resonance, including: a key depression state detecting means detecting whether a key which is in a specific relation with a played key is already depressed or not when a key playing operation is performed; a specific relation detecting means detecting the relation between the played key and the depressed key when the key depression state detecting means detects that the key in the specific relation with the played key is already depressed; and a musical sound generation means sound generating a musical sound of the played key when the specific relation detecting means detects that the played key and the depressed key are in the specific relation which is set in advance, and generating a predetermined musical sound based on the relation between the played key and the depressed key from a position of the depressed key.

Besides, as another aspect of the present invention, the musical sound generation means generates a monaural resonance, makes the position of the depressed key to be a sound generation source by sound generating the generated monaural resonance from left-and-right speakers with a volume in accordance with the key depressed position to make a sound generation position panning.

Besides, as still another aspect of the present invention, the musical sound generation means controls the volume of the resonance based on the relation between the key played position and the key depressed position.

According to the present invention, a resonance generation method of an electronic musical instrument having a digital signal processing unit artificially creating a resonance, including: a key depression state detecting process detecting whether a key which is in a predetermined relation with a played key is already depressed or not when a key playing operation is performed; a specific relation detecting process detecting the relation between the played key and the depressed key when the key depression state detecting process detects that the key in the predetermined relation with the played key is already depressed; and a musical sound generation process sound generating a musical sound of the played key when the specific relation detecting process detects that the played key and the depressed key are in the specific relation set in advance, and generating a predetermined musical sound based on the relation between the played key and the depressed key so that a position of the depressed key is to be a sound generation source.

Besides as another aspect of the present invention, the musical sound generation process generates a monaural resonance, makes a sound generation position panning by sound generating the generated monaural resonance from left-and-right speakers with a volume in accordance with the key depressed position to make the key depressed position to be a sound generation source.

Besides as still another aspect of the present invention, the musical sound generation process controls the volume of the resonance based on the relation between the key played position and the key depressed position.

According to the present invention, a computer program product for executing a resonance generation method of an electronic musical instrument having a digital signal processing unit artificially creating a resonance, including: a key depression state detecting process detecting whether a key which is in a predetermined relation with a played key is already depressed or not when a key playing operation is performed; a specific relation detecting process detecting the relation between the played key and the depressed key when the key depression state detecting process detects that the key in the predetermined relation with the played key is already depressed; and a musical sound generation process sound generating a musical sound of the played key when the specific relation detecting process detects that the played key and the depressed key are in the specific relation set in advance, and generating a predetermined musical sound based on the relation between the played key and the depressed key so that a position of the depressed key is to be a sound generation source.

According to the present invention, a computer readable recording medium recording computer programs to execute a resonance generation method of an electronic musical instrument having a digital signal processing unit artificially creating a resonance, including: a key depression state detecting process detecting whether a key which is in a predetermined relation with a played key is already depressed or not when a key playing operation is performed; a specific relation detecting process detecting the relation between the played key and the depressed key when the key depression state detecting process detects that the key in the predetermined relation with the played key is already depressed; and a musical sound generation process sound generating a musical sound of the played key when the specific relation detecting process detects that the played key and the depressed key are in the specific relation set in advance, and generating a predetermined musical sound based on the relation between the played key and the depressed key so that a position of the depressed key is to be a sound generation source.

BRIEF DESCRIPTION OF THE DRAWINGS

FIG. 5 is a view showing a specific relational example between a played key and a depressed key.

DETAILED DESCRIPTION OF THE PREFERRED EMBODIMENTS

Next, embodiments of a resonance generation device of an electronic musical instrument, a resonance generation method of the electronic musical instrument, a computer program, and a recording medium according to the present invention is described with reference to the attached drawings.

Figure 1:
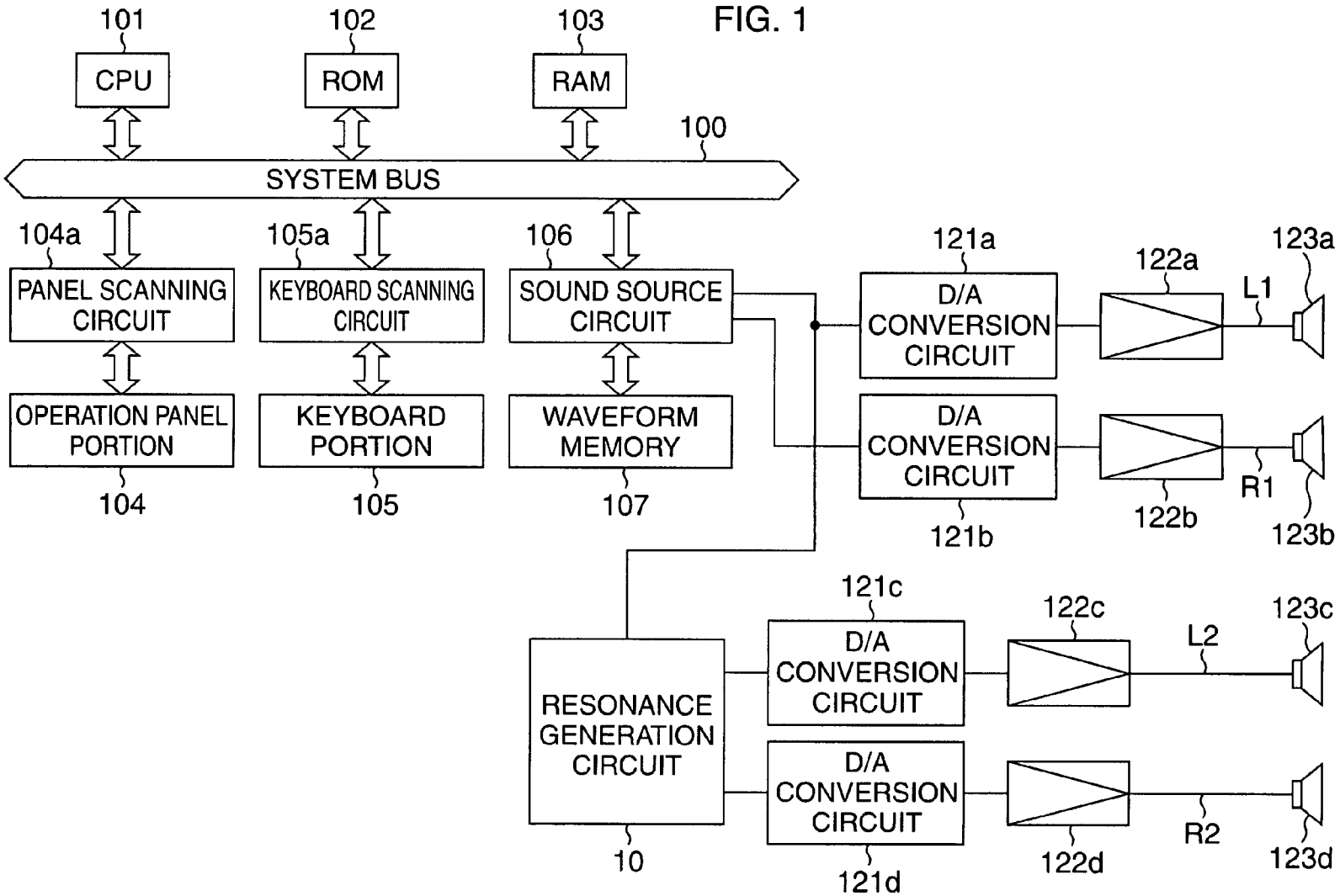
FIG. 1 shows an embodiment of the present invention, and is a block diagram explaining a configuration of a substantial part of an electronic piano.

FIG. 1 is a block diagram showing an example of the embodiment of the electronic piano applying the present invention.

As a configuration of the electronic piano shown in FIG. 1, a CPU (Central Processing Unit) 101, a ROM (Read Only Memory) 102, a RAM (Random Access Memory) 103, an operation panel portion 104 connected via a panel scanning circuit 104*a*, a keyboard portion 105 connected via a keyboard scanning circuit 105*a*, and a sound source circuit 106 are respectively connected to a system bus 100, and it is constituted so that transfers of various orders or data to these devices are performed via the system bus 100.

Besides, in the sound source circuit 106, a DSP (Digital Signal Processor (not shown)) processing a musical sound signal outputted from the sound source circuit 106, D/A conversion circuits 121*a* and 121*b* converting the musical sound signal processed there into an analog signal, and main amplifiers 122*a* and 122*b* amplifying them are provided.

In addition, a speaker 123*a* sound generating an original sound series signal L1 outputted from the main amplifier 122*a* toward outside, and a speaker 123*b* sound generating an original sound series signal R1 outputted from the main amplifier 122*b* toward outside are provided.

Besides, in the present embodiment, a resonance generation circuit 10 is provided, the original sound series signal L1 of one side among the original sound series signals outputted from the sound source circuit 106 is supplied to the resonance generation circuit 10, and as stated below, a resonance is sound generated when a key which is in a specific relation is depressed at the time a key playing is performed, and thereby, a musical sound capable of obtaining a spread feeling and a sound quality feeling close to a natural musical instrument can be generated.

The CPU 101 is to control respective portions of the electronic piano in accordance with control programs stored in a program memory storage unit of the ROM 102. Besides, the CPU 101 executes application programs stored in the program memory storage unit, uses the RAM 103 as a work area if necessary, and further performs data processes while using various fixed data stored in the ROM 102.

The ROM 102 stores various fixed data used by the CPU 101 in addition to the programs controlling all over the electronic piano as stated above.

The RAM 103 stores status information of devices, and is used as the work area by the CPU 101. Incidentally, various registers, flags, and so on to control the electronic piano are defined in the RAM 103, and this RAM 103 is accessed by the CPU 101 via the system bus 100.

At the operation panel portion 104, various switches such as a power switch, a tone selection switch, and a display unit displaying predetermined information are provided. The panel scanning circuit 104*a* interposing between the operation panel portion 104 and the system bus 100 checks set/reset states of the respective switches (not shown) provided at the operation panel portion 104, and detects panel switch data in ON states to transmit to the CPU 101.

The keyboard portion 105 is composed of plural keyboards and a keyboard switch opens/closes in working with key depressions and key releases of these keyboards. The keyboard scanning circuit 105*a* interposing between the keyboard portion 105 and the system bus 100 checks a state of the keyboard switch, generates a touch data showing an intensity (speed) of a keyboard touch from a signal showing an ON/OFF state thereof, and outputs ON/OFF information and a keyboard number thereof. The ON/OFF information, the keyboard number, and the touch data are transmitted to the CPU 101 via the system bus 100.

The sound source circuit 106 reads an original sound waveform data corresponding to a signal outputted from the CPU 101, from a waveform memory 107, multiplies an envelop to the musical sound waveform data, and outputs as left-and-right musical sound signals.

The resonance generation circuit 10 is housed in the above-stated DSP, and an output of the resonance generation circuit 10 is processed at a different system without added to a signal of an original sound component, in the present embodiment. Besides, the resonance generated at the resonance generation circuit 10 is processed in two series.

Namely, the D/A conversion circuits 121*c* and 121*d* converting a digital resonance signal outputted from the resonance generation circuit 10 into an analog signal, and the main amplifiers 122*c* and 122*d* amplifying them are provided. Besides, the speaker 123*c* sound generating a left side resonance signal L2 outputted from the main amplifier 122*c* toward outside is provided, and the speaker 123*d* sound generating a right side resonance signal R2 outputted from the main amplifier 122*d* toward outside is provided.

Figure 2:
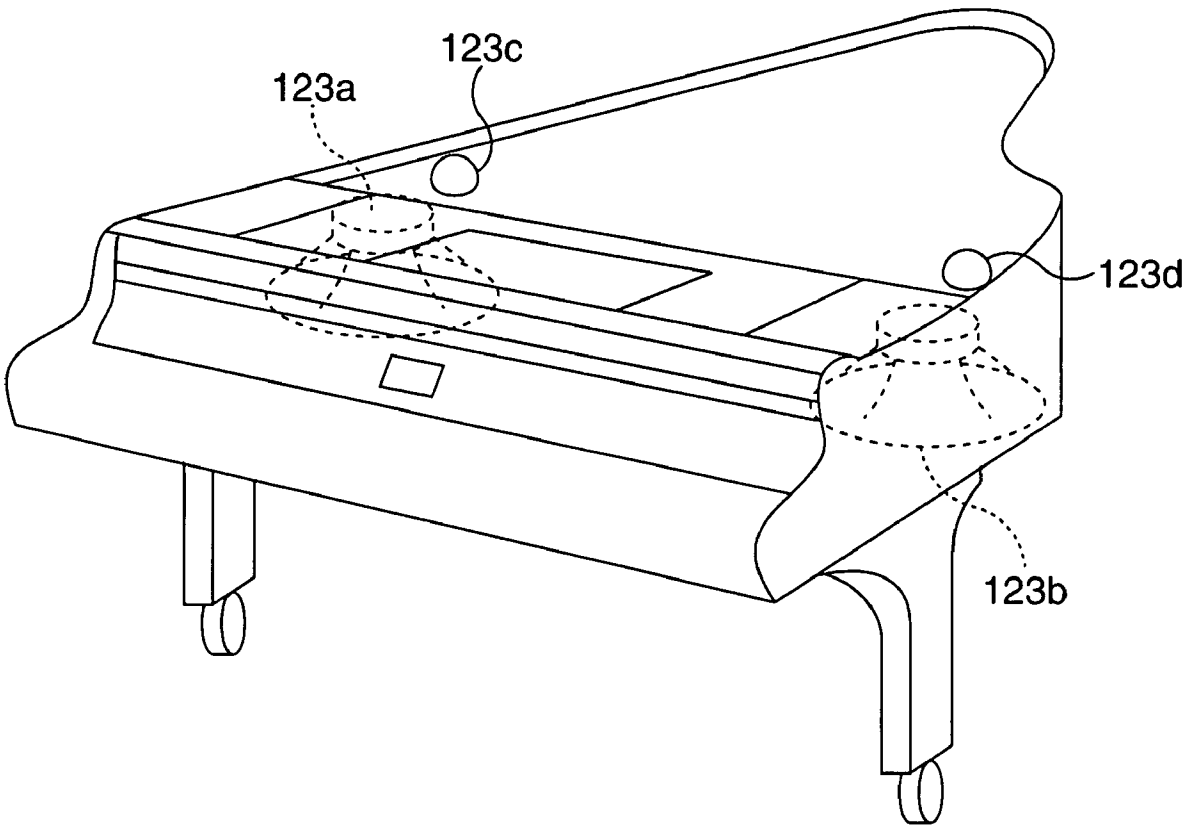
FIG. 2 is a view showing an appearance of the electronic piano according to the embodiment.

An appearance of the electronic piano according to the present embodiment is shown in FIG. 2. As shown in FIG. 2, the electronic piano according to the present embodiment is constituted as the electronic piano having an appearance of a grand piano. As a merit of the electronic piano in this type, a large flexibility in speaker dispositions owing to a space in a depth direction, in addition to a luxury of appearance can be cited, and therefore, a number of speakers can be disposed upward, and a vigorous sound can be reproduced.

Incidentally, in the constitution of the above-stated electronic piano, an example is shown in which the speakers 123*a* and 123*b* reproducing the original sound and the speakers 123*c* and 123*d* reproducing the resonance are disposed at both sides, left-and-right of the electronic piano, to simplify the constitution having no direct relation with the present invention. However, when the electronic piano is constituted actually, it is desirable that the original sound series are to be reproduced from bass to treble, and therefore, it goes without saying that it may have the constitution of a two-way system, a three-way system, or full-range speakers which are generally known.

In the resonance generation circuit 10, the resonance signal is generated from an inputted original sound signal. A publicly known constitution can be adopted as a constitution to generate the resonance signal. For example, unnecessary bass component and treble component may be cut by a band-pass filter, and a damping signal is created while putting a delay by the filter. The signal is further put the delay, and a signal to be a lingering sound may be added.

Further, a volume of the resonance created at the resonance generation circuit 10 inside of the DSP is set to correspond to a velocity. Namely, it is constituted so that the resonance becomes large when the keyboard is played strongly, and the resonance becomes small when it is played weakly.

An outline of a creation method of the resonance is described hereinabove. In the present embodiment, a key depression state detecting means and a specific relation detecting means are constituted by a computer system composed of the CPU 101, the ROM 102, and the RAM 103, and a predetermined resonance is sound generated when a predetermined condition is satisfied during a musical performance. Hereinafter, operations of the electronic piano according to the present embodiment are described with reference to flow charts in FIG. 3 and FIG. 4.

Figure 3:
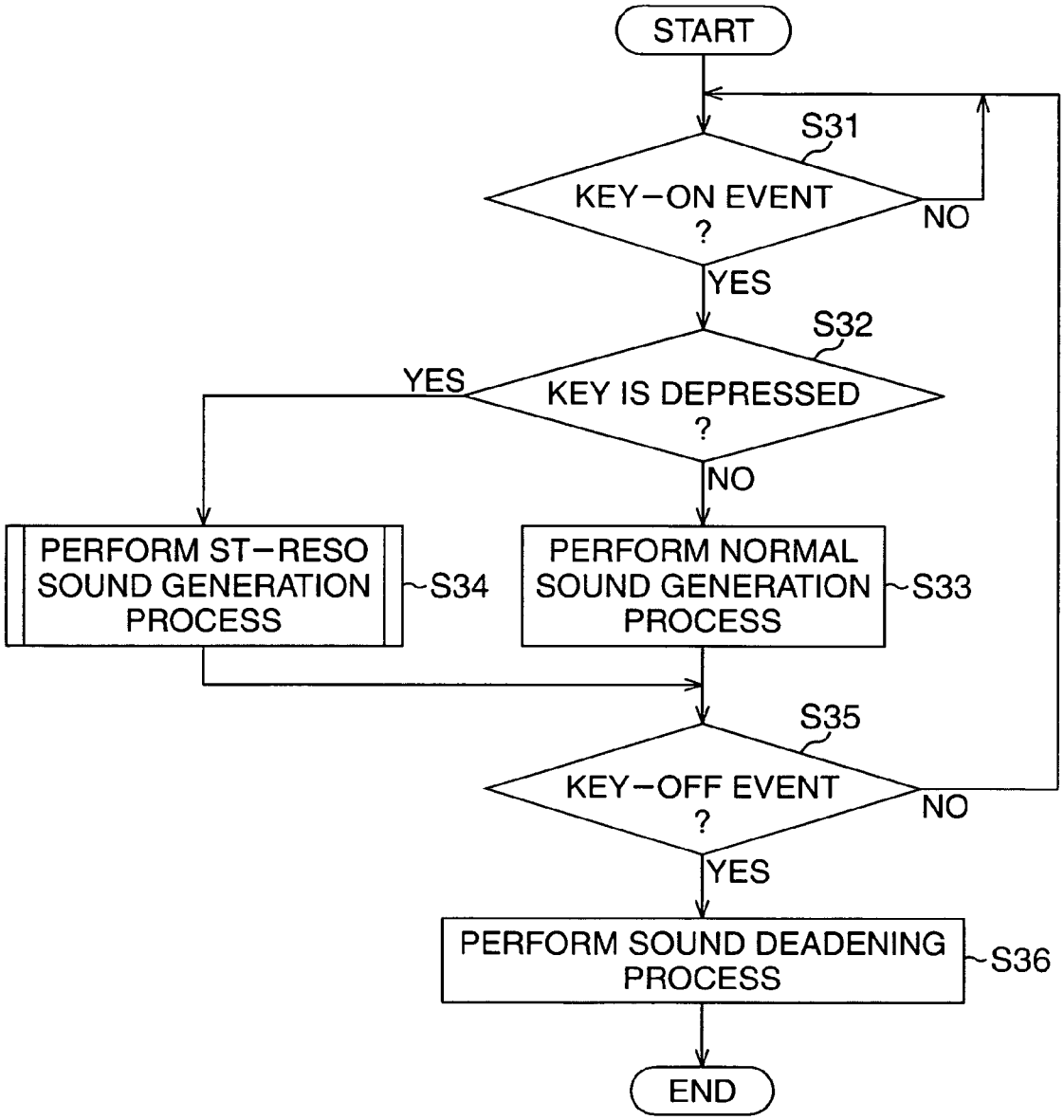
FIG. 3 is a flow chart explaining an outline of a process performed at a time of a key-on event.

As shown in the flow chart in FIG. 3, after a process is started, a presence/absence of an occurrence of a key-on event (key playing) is detected by the keyboard scanning circuit 105*a* at a first step S31. When the panel scanning circuit 104*a* detects that a key playing operation is performed, it goes to a step S32 to detect whether another key is depressed or not at the time the key is played, by the key depression state detecting means.

As a result of the detection by the key depression state detecting means, it goes to a step S33 when another key is not depressed at the time the key is played, and a normal sound generation process is performed. Besides, as a result of the detection of the step S32, when another key is depressed at the time the key is played, it goes to a step S34, and a strings resonance (hereinafter, referred to as "st-reso") process is performed. A detail of the above-stated st-reso process will be described later.

Next, in a step S35, it is detected whether a key-off event is occurred or not. When the key-off event is not occurred as a result of this detection, it goes back to the step S31 to perform the above-stated process repeatedly. Besides, in the step S35, when the occurrence of the key-off event is detected, it goes to a step S36, and a sound deadening process is performed to terminate the process.

Figure 4:
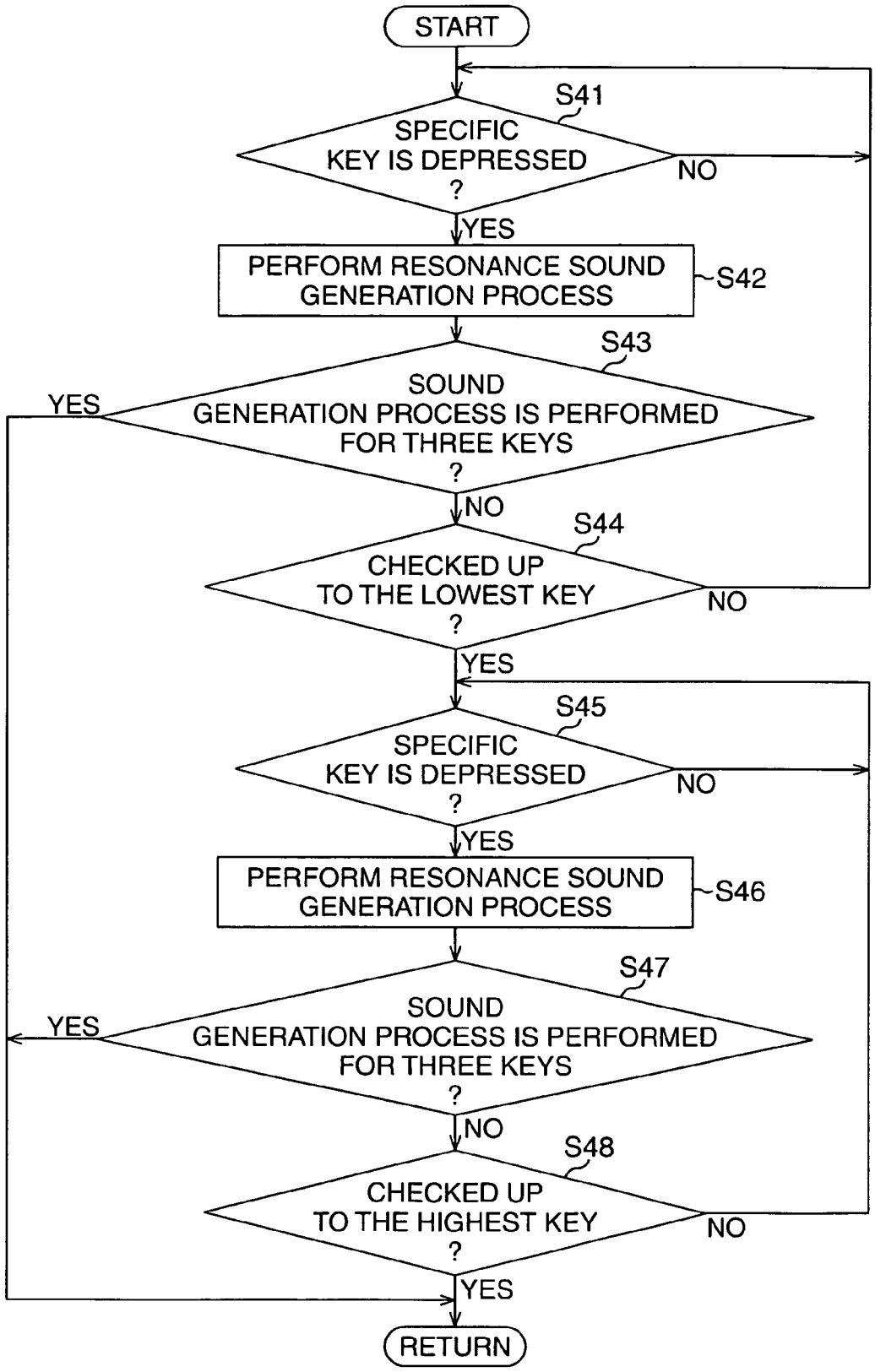
FIG. 4 is a flow chart explaining an outline of a st-reso process performed when a key is depressed at a key played time.

Next, an outline of the st-reso process performed at the step S34 is described with reference to the flow chart in FIG. 4.

In this st-reso process, processes as shown in the following are performed after the normal sound generation process is performed in accordance with the key playing.

At first, in a first step S41, it is detected whether a specific key is depressed at the time a key playing is performed. This detection is performed toward a lower scale from the key which is played. For example, a data table as shown in FIG. 5 is held in the ROM 102 as for the specific relation between the played key and the depressed key.

As shown in FIG. 5, in the present embodiment, the resonance is sound generated when a difference between the depressed key and the played key, namely (played key−depressed key) is in a specific relation. In examples shown in FIG. 5, the resonance is sound generated at the played key as for the cases when "+12*N+2 (N: 3 and above)", "+12*N+10 (N: 2 and above)", "+12*N+4 (N: 2 and above)", "+12*N+7 (N: 1 and above)", and "+12*N (N: 1 and above)". Concrete examples thereof are as shown in FIG. 5.

Besides, the resonance is sound generated at a "depressed key+19 keys" when a (played key−depressed key) value is "+7", at a "depressed key+24 keys" when the value is "+5", at a "depressed key" when the value is "±1", at a "depressed key+19 keys" when the value is "−5", at a "depressed key+12 keys" when the value is "−7", and at a "depressed key" when the value is "−12*N (N: 1 and above)" and "−12*N−7 (N: 1 and above)".

When the key which is in the specific relation as shown in FIG. 5 is depressed as a result of a judgment in the step S41, it goes to a step S42, and the sound generation process of the resonance is performed. This sound generation process will be described later in detail.

Next, it goes to a step S43 to judge whether the sound generation processes of the resonances are performed or not for three keys. As a result of this judgment, when the sound generation processes for three keys are performed, it quits the st-reso sound generation process to return. Besides, when the sound generation processes for three keys are not performed, it is judged whether the depression state is checked or not up to a key positioning at the lowest. As a result of this judgment, when it is not checked up to the key at the lowest side, it goes back to the step S41 to perform the above-stated processes repeatedly.

Besides, as a result of the judgment in the step S44, when the check is performed up to the lowest side key, a presence/absence of the key applicable to the above-stated specific key is sequentially judged from the lowest key among the depressed keys higher than the played key. As a result of this judgment, when the specific key is depressed, it goes to a step S46, and the sound generation process of the resonance is performed.

Next, at a step S47, it is judged whether the sound generation processes of the resonance are performed or not for three keys. As a result of this judgment, when the processes are performed for three keys, it quits the process to return. Besides, when the processes are not performed for three keys, it goes back to the step S45 to perform the above-stated processes repeatedly. When a key up to the highest side is checked, the st-reso process is terminated to return.

As a resonance for st-reso, a monaural sound is used. This is because it is effective to make a resonance sound generation position to be the key depressed position. Namely, the monaural resonance is generated at the resonance generation circuit 10, sound generated from the left-and-right speakers 123*c*, 123*d* with a volume in accordance with the position of the depressed key, to thereby make the sound generation position panning. Consequently, when the key depressed position is at a center, it is sound generated from the left-and-right speakers 123*c*, 123*d* with the same volume, and when the key depressed position is at a left side, it is sound generated with a larger volume from the speaker 123*c* disposed at the left side of the electronic piano than the speaker 123*d* disposed at a right side. On the contrary, when the key depressed position is at the right side, it is sound generated with the larger volume from the speaker 123*d* disposed at the right side than the speaker 123*c* disposed at the left side.

It becomes possible to make the position where the resonance is sound generated at the key depressed position by performing the sound generation as stated above, and a spread feeling and a sound quality feeling close to a natural musical instrument such as an acoustic piano can be obtained.

Besides, in the present embodiment, the volume of the resonance is controlled based on the relation between the played key and the depressed key. For example, the volume of the resonance for the resonance of the highest tone is set as follows: when the relation between the played key and the depressed key is "within one octave", the volume is to be "reduced by two decibels", when the relation is "within two octaves", the volume is "reduced by three decibels", when the relation is "within three octaves", the volume is "reduced by four decibels", and so on.

In the electronic piano according to the present embodiment, the resonance in monaural sound is generated as stated above, the volume to be sound generated is made different in accordance with the key depressed position, and thereby, the resonance close to the natural resonance sound generated from the acoustic piano can be sound generated.

Incidentally, the resonance generation device of the electronic musical instrument according to the present invention is not limited to the embodiment stated above, but it is to be understood that all the changes and modifications without departing from the range of the following claims of the present invention are to be included therein.

OTHER EMBODIMENTS

A program code of a software to realize the function of the above-stated embodiment is supplied to a computer within devices or a system connected to the above-stated various devices so as to operate various devices to realize the function of the above-stated embodiment, and the one embodied by operating the various devices according to the program stored in the computer (CPU or MPU) of the system or the devices is also included in a range of the present invention.

Besides, in this case, the program code of the software in itself realizes the function of the above-stated embodiment, and therefore, the program code in itself and a means to supply the program code to the computer, for example, a recording medium storing such program code constitute the present invention. As the recording medium recording such program code, for example, a flexible disk, a hard disk, an optical disk, a magnetic optical disk, a CD-ROM, a magnetic tape, a nonvolatile memory card, a ROM, and so on can be used.

Besides, not only a case when the computer executes the supplied program code to thereby realize the function of the above-stated embodiment, but also a case when the program code works together with an OS (operating system), other application softwares, or the like operating in the computer to realize the function of the above-stated embodiment, the program code is included in the embodiment of the present invention.

Further, when the supplied program code is stored in a memory included in a function expansion unit connected to a function expansion board of a computer or to the computer, and thereafter, a CPU and so on included in the function expansion board or the function expansion unit performs a part or all of actual processes based on instructions of the program code to thereby realize the function of the above-stated embodiment, it is also included in the present invention.

INDUSTRIAL APPLICABILITY

According to the present invention, it is detected whether a key which is in a specific relation with a played key is already depressed or not when a key playing operation is performed. When the key in the specific relation with the played key is already depressed, the relation between the played key and the depressed key is checked. When the played key and the depressed key is in the specific relation which is set in advance, a musical sound of the played key is sound generated, and a predetermined musical sound based on the relation between the played key and the depressed key is generated so that a position of the depressed key is to be a sound generation source. Consequently, it is possible to provide an electronic musical instrument capable of obtaining a spread feeling and a sound quality feeling close to a natural musical instrument.

What is claimed is:

1. A resonance generation device of an electronic musical instrument including a keyboard comprising keys including at least one depressed key and a played key, and a digital signal processing unit artificially creating a resonance; the resonance generation device comprising:

a key depression detector detecting whether the depressed key is already depressed at a time when the played key different from the depressed key is played, wherein the played key is played when not all remaining keys are already depressed;

a specific relation detector detecting a specific relation between a pitch of the played key and a pitch of the already depressed key, wherein the specific relation detector sequentially judges presence/absence of a specific relation starting from a lowest key among the at least one depressed key higher than the played key; and a musical sound generator generating a predetermined musical sound set in advance based on the specific relation between the pitch of the played key and the pitch of the depressed key;

wherein a position, which generates the musical sound set in advance based on the specific relation between the pitch of the played key and the pitch of the depressed key, is a position of the depressed key;

wherein the musical sound generator comprises a data table including specific relations and resonance pitches, the resonance pitches being a function of the specific relations;

wherein a resonance pitch from the data table is added to the musical sound, and the resonance pitch is one of (a) the pitch of the depressed key, (b) the pitch of the played key, or (c) the pitch of the depressed key plus a third pitch comprising an additional number of semitones above the pitch of the depressed key;

wherein the resonance pitch is extracted from the data table in response to the specific relation between a pitch of the played key and a pitch of the already depressed key; and wherein the digital signal processing unit generates a musical sound including the resonance pitch.

2. The resonance generation device of the electronic musical instrument according to claim 1, wherein said musical sound generator generates a monaural resonance, the generated monaural resonance being output from left-and-right speakers with a respective volume in accordance with a position of the depressed key to make sound generation position panning.

3. The resonance generation device of the electronic musical instrument according to claim 2, wherein said musical sound generator controls the volume of the resonance based on a relation between a position of the played key and the position of the depressed key.

4. A resonance generation method of an electronic musical instrument including a keyboard comprising keys including at least one depressed key and a played key, and a digital signal processing unit artificially creating a resonance; the resonance generation method comprising:

a key depression detecting process detecting whether the depressed key is already depressed at a time when the played key different from the depressed key is played, wherein the played key is played when not all remaining keys are already depressed;

a specific relation detecting process detecting a specific relation between a pitch of the played key and a pitch of the already depressed key, wherein the specific relation detector sequentially judges presence/absence of a specific relation starting from a lowest key among the at least one depressed key higher than the played key; and a musical sound generation process generating a predetermined musical sound based on the specific relation between the pitch of the played key and the pitch of the depressed key;

wherein a position, which generates the musical sound set in advance based on the specific relation between the pitch of the played key and the pitch of the depressed key, is a position of the depressed key;

wherein the musical sound generation process comprises providing a data table including specific relations and resonance pitches, the resonance pitches being a function of the specific relations;

adding a resonance pitch from the data table to the musical sound, wherein the resonance pitch is one of (a) the pitch of the depressed key, (b) the pitch of the played key, or (c) the pitch of the depressed key plus a third pitch comprising an additional number of semitones above the pitch of the depressed key;

extracting the resonance pitch from the data table in response to the specific relation between a pitch of the played key and a pitch of the already depressed key; and generating a musical sound, including the resonance pitch, in the digital signal processing unit.

5. The resonance generation method of the electronic musical instrument according to claim 4, wherein said musical sound generation process includes generating a monaural resonance, the generated monaural resonance being output from left-and-right speakers with a respective volume in accordance with a position of the depressed key to make sound generation position panning.

6. The resonance generation method of the electronic musical instrument according to claim 5, wherein said musical sound generation process comprises controlling the volume of the resonance based on a relation between a position of the played key and the position of the depressed key.

7. A computer program product for executing the resonance generation method according to claim 4.

8. A computer-readable recording medium recording a computer program for executing the resonance generation method according to claim 4.

9. A resonance generation method of an electronic musical instrument including a keyboard comprising keys and a digital signal processing unit artificially creating a resonance; the resonance generation method comprising:

detecting an occurrence of a key-on event, of a played key;

determining whether a depressed key is already depressed at the time of the key-on event;

(a) if no key other than the played key is depressed, performing a normal sound generation process;

(b) if any key other than the played key is depressed, performing a strings resonance process further comprising (i) determining, by sequentially judging specific-relation presence/absence starting from a lowest key among depressed keys higher than the played key, whether the played key and the depressed key are in a specific pitch relation which is set in advance, and (ii) generating a predetermined musical sound based on the specific pitch relation between the played key and the depressed key sequentially from the depressed keys judged as being applicable to the above specific relation; wherein, in the step of generating, a position, which generates the musical sound set in advance based on the specific relation between the pitch of the played key and the pitch of the depressed key, is a position of the depressed key; and wherein the musical sound generation process comprises providing a data table including specific relations and resonance pitches, the resonance pitches being a function of the specific relations;

adding a resonance pitch from the data table to the musical sound, wherein the resonance pitch is one of (a) the pitch of the depressed key, (b) the pitch of the played key, or (c) the pitch of the depressed key plus a third pitch comprising an additional number of semitones above the pitch of the depressed key;

extracting the resonance pitch from the data table in response to the specific relation between a pitch of the played key and a pitch of the already depressed key; and generating a musical sound, including the resonance pitch, in the digital signal processing unit.

10. The resonance generation method of the electronic musical instrument according to claim 9, wherein the depressed key constitutes a first depressed key, and further comprising steps of:

determining whether a second key is already depressed at the time the key-on event;

if the second key is depressed, then performing a strings resonance process further comprising (i) determining whether the played key and the second depressed key are in another specific pitch relation, and (ii) generating another predetermined musical sound based on the specific pitch relation between the played key and the second depressed key.

11. The resonance generation method of the electronic musical instrument according to claim 10, further comprising steps of:

determining whether a third key is already depressed at the time the key-on event;

if the third key is depressed, then performing a strings resonance process further comprising (i) determining whether the played key and the third depressed key are in a specific pitch relation, and (ii) generating still another predetermined musical sound based on the specific pitch relation between the played key and the third depressed key.

12. The resonance generation method of the electronic musical instrument according to claim 11, comprising generating no predetermined musical sound based on the specific pitch relation between the played key and an nth already-depressed key, where n is an integer greater than three.

13. The resonance generation method of the electronic musical instrument according to claim 9, comprising controlling a volume of the resonance as a function of the specific pitch relation between the played key and the depressed key.

* * * * *